US009912046B2

(12) United States Patent
Motomura et al.

(10) Patent No.: US 9,912,046 B2
(45) **Date of Patent: *Mar. 6, 2018**

(54) ROOF ANTENNA FOR VEHICLE

(71) Applicants: Kojima Industries Corporation, Toyota-shi, Aichi (JP); TOYOTA JIDOSHA KABUSHIKI KAISHA, Toyota-shi, Aichi-ken (JP)

(72) Inventors: Yusuke Motomura, Toyota (JP); Yuki Tomida, Toyokawa (JP)

(73) Assignees: KOJIMA INDUSTRIES CORPORATION, Toyota-Shi, Aichi (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/094,042

(22) Filed: Apr. 8, 2016

(65) Prior Publication Data

US 2016/0315376 A1 Oct. 27, 2016

(30) Foreign Application Priority Data

Apr. 22, 2015 (JP) ..... 2015-087287

(51) Int. Cl.
*H01Q 1/32* (2006.01)
*H01Q 1/42* (2006.01)
*H01Q 1/12* (2006.01)

(52) U.S. Cl.
CPC ..... *H01Q 1/3275* (2013.01); *H01Q 1/1214* (2013.01); *H01Q 1/42* (2013.01)

(58) Field of Classification Search
CPC ..... H01Q 1/1214; H01Q 1/3275
See application file for complete search history.

(56) References Cited

U.S. PATENT DOCUMENTS

2003/0068198 A1* 4/2003 Kozlovski ..... H01Q 1/1214 403/372
2004/0246196 A1 12/2004 Noro et al.
(Continued)

FOREIGN PATENT DOCUMENTS

JP 2004048599 A 2/2004
JP 2004363747 A 12/2004
(Continued)

OTHER PUBLICATIONS

Notice of Grounds for Rejection corresponding to Japanese Application No. 2015-087287; dated Apr. 25, 2017.
(Continued)

*Primary Examiner* — Daniel J Munoz
(74) *Attorney, Agent, or Firm* — Cantor Colburn LLP

(57) ABSTRACT

A roof antenna for a vehicle is provided having an antenna unit that receives radio waves, an antenna cover that covers the antenna unit, and an annular pad interposed between the antenna cover and the roof, wherein the pad has an antenna cover reception unit formed from an elastic structure formed at a portion, of the pad, opposing a lower end of the antenna cover, and that is pressed by the lower end of the antenna cover to elastically deform in a pressed direction, and a lip unit formed on an outer circumferential end of the antenna cover reception unit, that covers an outer circumference of the lower end of the antenna cover, and that is in contact with the roof.

2 Claims, 4 Drawing Sheets

(56) References Cited

U.S. PATENT DOCUMENTS

| | | | | |
|---|---|---|---|---|
| 2006/0097937 | A1* | 5/2006 | Gorai | H01Q 1/3275 343/713 |
| 2007/0046551 | A1* | 3/2007 | Tateno | H01Q 1/1214 343/713 |
| 2007/0075904 | A1* | 4/2007 | Blickle | H01Q 1/1214 343/715 |
| 2012/0081256 | A1 | 4/2012 | Aizawa et al. | |
| 2016/0020507 | A1* | 1/2016 | Kobayashi | H01Q 1/42 343/713 |

FOREIGN PATENT DOCUMENTS

| | | | |
|---|---|---|---|
| JP | 2012080388 | A | 4/2012 |
| JP | 2013229813 | A | 11/2013 |
| JP | 3189619 | U | 3/2014 |
| WO | 2013161520 | A1 | 10/2013 |
| WO | 2014136960 | A1 | 9/2014 |

OTHER PUBLICATIONS

USPTO Notice of Allowance corresponding to U.S. Appl. No. 15/094,076 dated Nov. 17, 2017.

* cited by examiner

ROOF ANTENNA FOR VEHICLE

PRIORITY INFORMATION

This application claims priority to Japanese Patent Application No. 2015-087287, filed on Apr. 22, 2015, the entire disclosure of which is incorporated herein by reference.

BACKGROUND

Technical Field

The present invention relates to a roof antenna for a vehicle, which is mounted on a roof of a vehicle.

Related Art

Various types of antennas exist as antennas to be mounted on a vehicle. As one of these antennas, roof antennas which are mounted on a roof of a vehicle are known. Because the roof antenna is mounted on a roof which is at the highest position of the vehicle body, a high reception sensitivity can be realized. As such a roof antenna, a roof antenna commonly called a "shark fin antenna" is known, which is superior in compactness and design.

This roof antenna has an antenna unit in which elements, a circuit board, and the like are integrated, an antenna cover covering the antenna unit, and a pad which hides a gap between a lower end of the antenna cover and the roof (for example, JP 2013-229813 A).

Because the roof antenna is mounted on the roof, the design (fine appearance) thereof is important. Because of this, it is necessary to make a lower end of the antenna cover closely contact the roof with a pad therebetween, to prevent a gap between the lower end of the antenna cover and the roof, and the antenna cover is designed to correspond to the roof shape (radius of curvature of the roof).

However, because the roof shape of the vehicle differs depending on the kind of vehicle, the shape of the antenna cover must be designed for each kind of vehicle, and a die is necessary for the antenna cover for each kind of vehicle. Consequently, for each kind of vehicle, the number of steps of design and cost of the die are increased, and it has been difficult to reduce the cost.

In consideration of the above, an advantage of the present invention is that a roof antenna for a vehicle is provided in which a same antenna cover can be used for different kinds of vehicles, and the cost related to the antenna cover can be reduced.

SUMMARY

According to one aspect of the present invention, there is provided a roof antenna for a vehicle, mounted on a roof of a vehicle, comprising: an antenna unit that receives radio waves; an antenna cover that covers the antenna unit; and an annular pad interposed between the antenna cover and the roof, wherein the pad comprises: an antenna cover reception unit formed from an elastic structure formed at a portion, of the pad, opposing a lower end of the antenna cover, and that is pressed by the lower end of the antenna cover to elastically deform in a pressed direction, and a lip unit formed at an outer circumferential end of the antenna cover reception unit, that covers an outer circumference of the lower end of the antenna cover, and that is in contact with the roof.

According to another aspect of the present invention, preferably, the antenna cover reception unit has a curved shape protruding in an upward direction as a cross sectional shape in a circumferential direction of the annular shape.

According to various aspects of the present invention, the same antenna cover may be used even for different kinds of vehicles, and the cost related to the antenna cover can be reduced.

DESCRIPTION OF EXEMPLARY EMBODIMENTS

Figure 1:
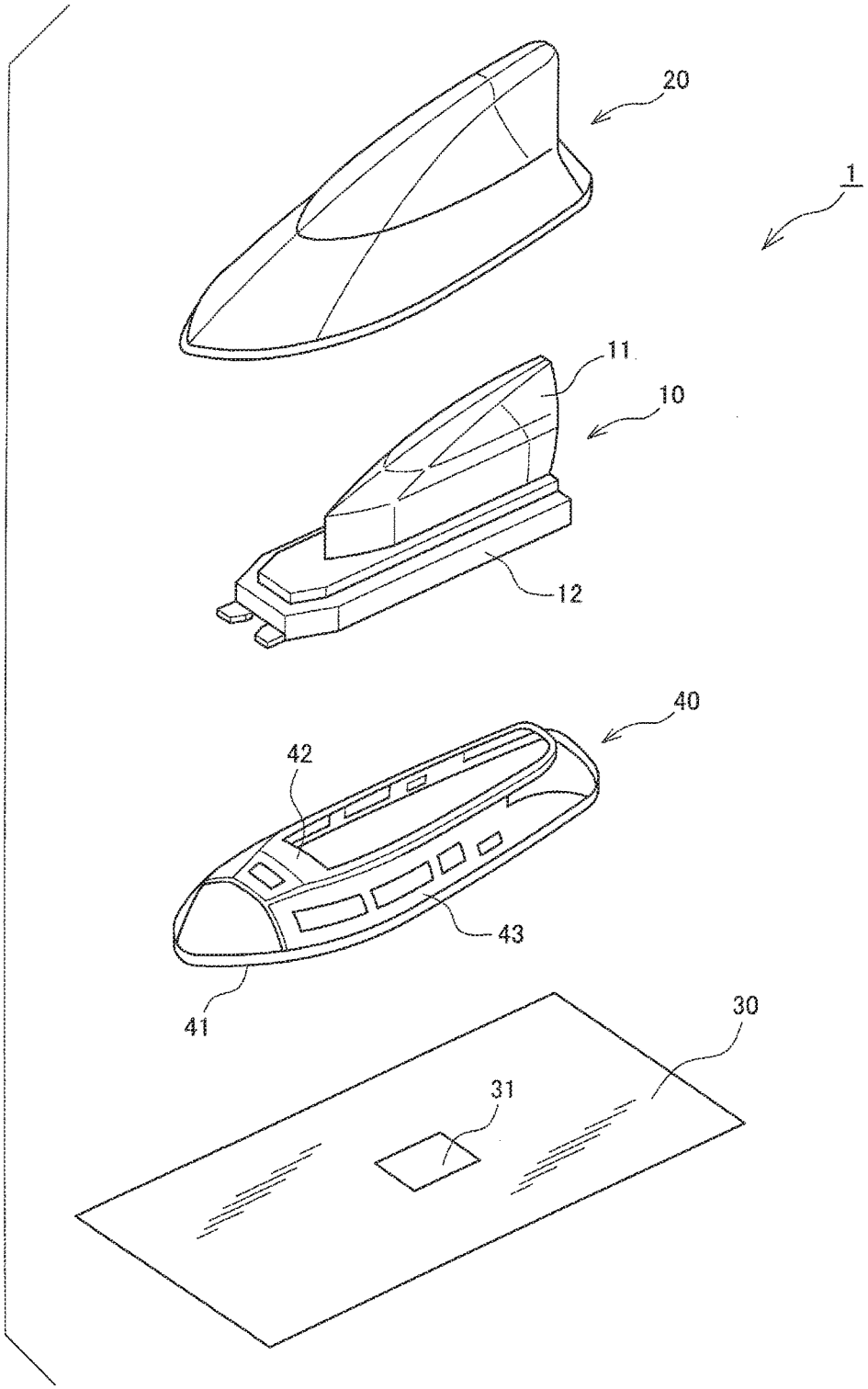
FIG. 1 is a detailed perspective view of a roof antenna.
Figure 2:
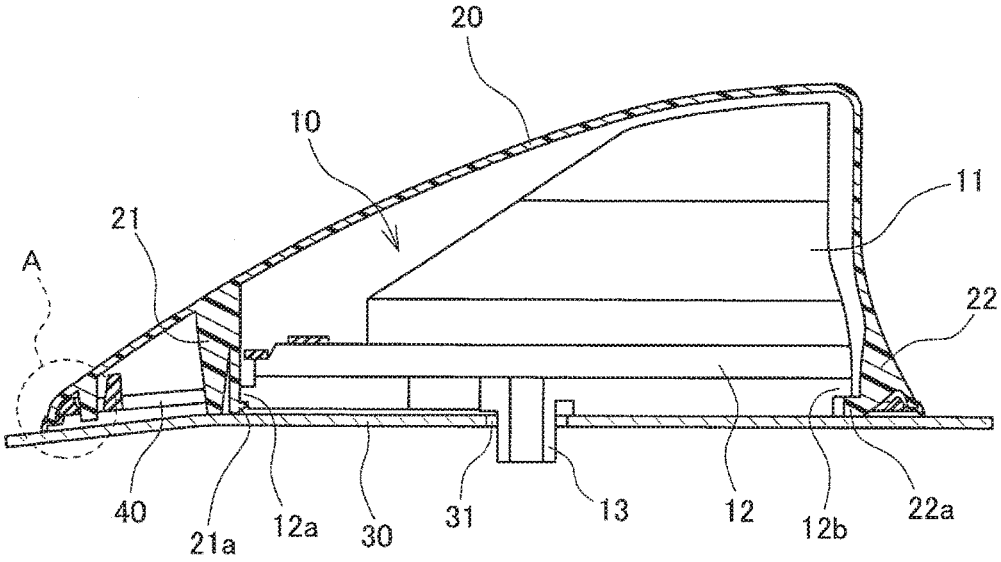
FIG. 2 is a cross sectional diagram of a roof antenna.

As shown in FIGS. 1 and 2, a roof antenna 1 to be mounted on a roof of a vehicle comprises an antenna unit 10 in which elements, a circuit board, and the like are integrated, an antenna cover 20 which covers the antenna unit 10, and a pad 40 which hides a gap between a lower end of the antenna cover 20 and a roof 30.

The antenna unit 10 has an antenna 11 which receives radio broadcast waves, digital television broadcast waves, and GPS radio waves, or the like, and an antenna board 12 which has a tuned circuit and an amplification circuit for the radio waves received by the antenna 11. On the antenna board 12, various antennas are equipped, and various antennas and the antenna board 12 are electrically connected to each other.

On a lower surface of the antenna board 12, a bolt fixation unit 13 which protrudes in the downward direction is formed. A screw is formed on a circumferential surface of the bolt fixation unit 13, and a nut (not shown) is screwed thereto. A center portion of the bolt fixation unit 13 has a hollow structure, and a cable from the antenna board 12 is placed through this portion. In addition, on the roof 30, a hole 31 through which the bolt fixation unit 13 is inserted is formed.

On a front end and a rear end of the antenna board 12, engagement units 12*a* and 12*b* for attaching the antenna cover 20 are provided. In addition, a plurality of engagement units (not shown) are also provided at a side end of the antenna board 12.

The antenna 11 is constructed by unitizing an antenna element around which an enamel line for receiving the radio broadcast waves is wound, a metal, rod-shaped antenna for receiving the digital television broadcast waves, and a patch antenna for receiving the GPS radio waves.

The antenna cover 20 is made of a synthetic resin, and has a so-called shark fin shape in which a width is increased from a front tip toward the rear side, and the cover protrudes in a streamlined shape toward the rear side. Moreover, the antenna cover 20 has an annular lower end edge corresponding to the shape of the roof 30.

A storage space which can store the antenna unit 10 is formed inside the antenna cover 20. In the inside of the antenna cover 20, a rib 21 which protrudes from an inner surface of the antenna cover 20 in the downward direction is provided at a portion opposing the engagement unit 12*a* of the antenna board 12, and an engagement hook 21*a* which engages the engagement unit 12*a* is formed at a tip of the rib 21. At a rear end of the antenna cover 20, a thick portion 22 is provided at a portion opposing the engagement unit 12*b* of the antenna board 12, and an engagement hook 22*a* which engages the engagement unit 12*b* is formed at an inner side of the thick portion 22. In addition, a plurality of engagement hooks (not shown) which engage the pad 40 are provided inside the antenna cover 20.

Figure 3:
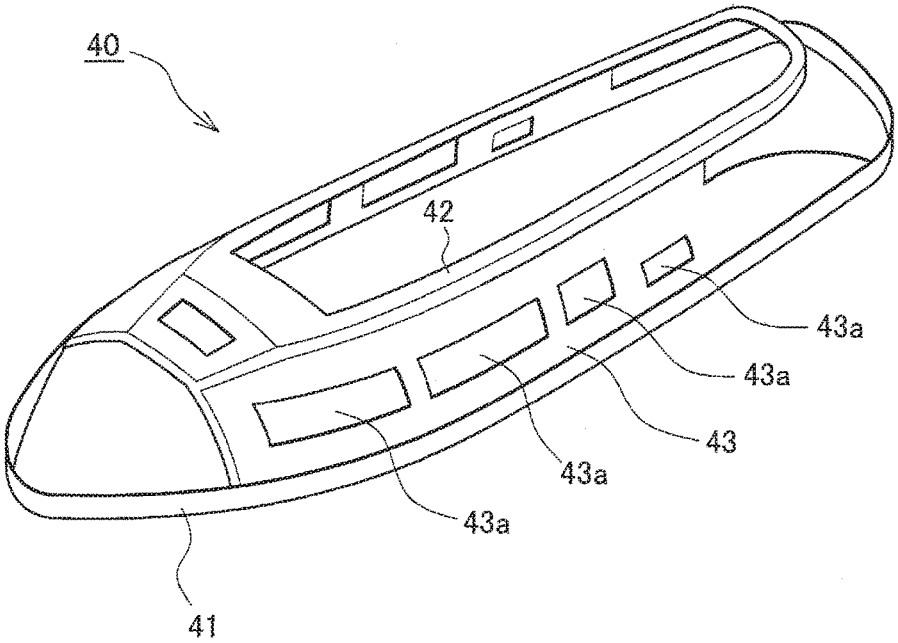
FIG. 3 is an enlarged perspective view of a pad.

As shown in FIG. 3, the pad 40 has an annular outer ring section 41 formed by an elastic member such as elastomer and which contacts a lower end edge of the antenna cover 20, an inner ring section 42 formed at an inner side of the outer ring section 41 and which contacts an upper surface of the antenna board 12, and a connection unit 43 which connects the outer ring section 41 and the inner ring section 42 at a plurality of locations.

The connection unit 43 is formed from a side wall sloped from an edge of the inner ring section 42 toward the outer ring section 41, and a plurality of holes 43*a* are formed at portions which interfere the antenna board 12. In addition, an engagement unit to which an engagement hook (not shown) provided inside the antenna cover 20 engages is provided in the connection unit 43.

Figure 4:
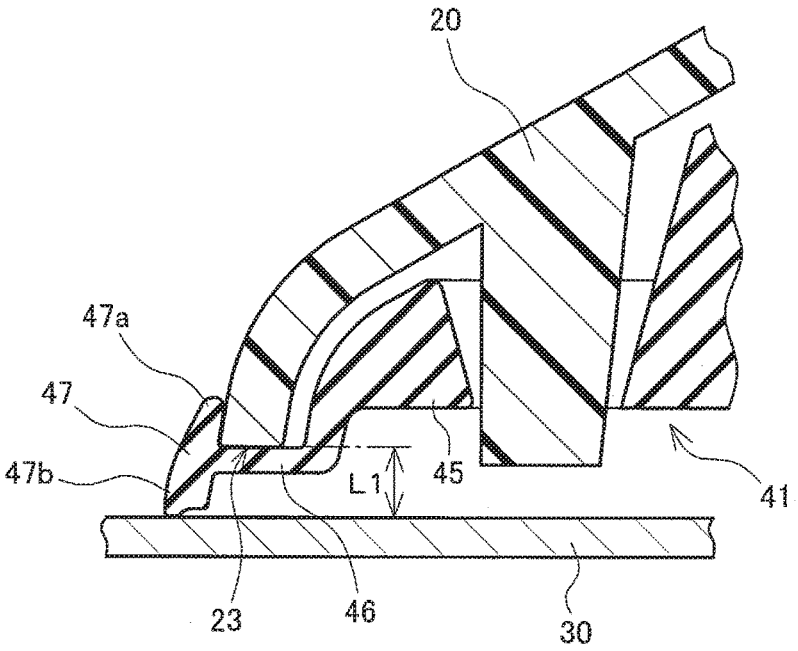
FIG. 4 is an enlarged cross sectional diagram showing a state of an antenna cover and a pad when a radius of curvature of the roof is large.
Figure 5:
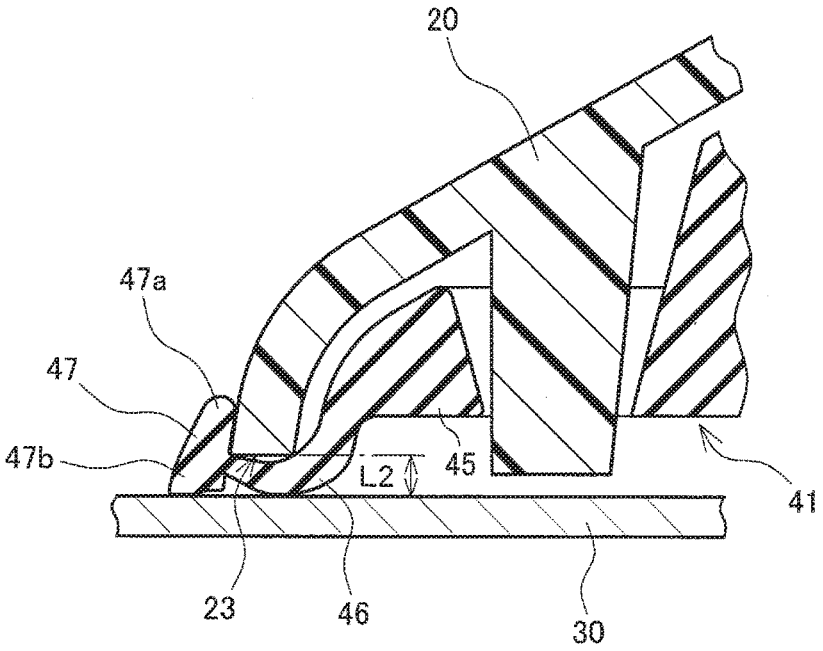
FIG. 5 is an enlarged cross sectional diagram showing a state of an antenna cover and a pad when a radius of curvature of the roof is small.

FIGS. 4 and 5 show enlarged views of a part A in FIG. 2. As shown in FIGS. 4 and 5, the outer ring section 41 has a base 45 which primarily forms an annular portion of the outer ring section 41, an antenna cover reception unit 46 which opposes an end surface of the lower end edge of the antenna cover 20, and a lip unit 47 which covers the outer circumference of the lower end edge of the antenna cover 20 and which contacts the roof 30. The base 45, the antenna cover reception unit 46, and the lip unit 47 are formed over the entire circumference of the outer ring section 41.

The antenna cover reception unit 46 which extends downward and then curves toward the outer circumferential direction approximately parallel to the roof 30 is formed at a tip on the outer circumferential side of the base 45. The antenna cover reception unit 46 is formed in a thin plate shape, and thus can deflect by being elastically deformed. An end surface 23 of the lower end edge of the antenna cover 20 contacts the upper surface of the antenna cover reception unit 46, and the upper surface of the antenna cover reception unit 46 receives the end surface 23 of the lower end edge of the antenna cover 20.

The lip unit 47 having an approximately triangular cross section with an upper side being an acute angle is formed at a tip on the outer circumferential side of the antenna cover reception unit 46. The tip on the outer circumferential side of the antenna cover reception unit 46 is connected to an approximate center portion in the up-and-down direction of the lip unit 47. The lip unit 47 includes an upper lip 47*a* which extends from the connection unit of the antenna cover reception unit 46 in the upward direction, and a lower lip 47*b* which extends from the connection unit of the antenna cover reception unit 46 in the downward direction. An inner side surface of the upper lip 47*a* contacts the outer circumference of the lower end edge of the antenna cover 20, and covers the outer circumference of the lower end edge of the antenna cover 20. A lower end of the lower lip 47*b* contacts the roof 30.

Next, assembly of the roof antenna 1 will be described. First, various constitutent components of the antenna unit 10, such as the antenna 11 and the antenna board 12 are assembled to unitize the components, and form the antenna unit 10. The antenna board 12 of the unitized antenna unit 10 is passed through an inner side of the inner ring section 42 of the pad 40 to assemble the pad 40 onto the antenna unit 10. Alternatively, the antenna unit 10 may be passed in the inner side of the inner ring section 42 of the pad 40 from an upper part of the antenna unit 10, to assemble the pad 40 onto the antenna unit 10.

When the pad 40 is assembled to the antenna unit 10, the pad 40 and the antenna unit 10 are assembled by combining the inner ring section 42 of the pad 40 and the upper surface of the antenna unit 10. Then, the antenna cover 20 is assembled in a manner to cover the antenna unit 10 from above the antenna unit 10.

The engagement hooks 21*a* and 22*a* of the antenna cover 20 and the engagement hooks which engage the pad 40 respectively engage the engagement units 12*a* and 12*b* of the antenna board 12 and the engagement unit of the pad 40, so that the antenna cover 20, the antenna unit 10, and the pad 40 are integrated and the unit of the roof antenna 1 is completed.

The bolt fixation unit 13 of the antenna unit 10 is inserted through the hole 31 formed in the roof 30, and the roof antenna 1 is fixed on the roof 30 by the nut (not shown).

Cases where the roof antenna 1 is mounted on roofs 30 having different radii of curvature will now be described. First, a case of the roof 30 with a large radius of curvature will be described. As shown in FIG. 4, when the radius of curvature of the roof is large, the end surface 23 of the lower end edge of the antenna cover 20 and the roof 30 are distanced from each other (shown with "L1" in the figure). The end surface 23 of the lower end edge of the antenna cover 20 is lightly pressed on the upper surface of the antenna cover reception unit 46, and the end surface 23 of the antenna cover 20 is in contact with the upper surface of the antenna cover reception unit 46. In this case, the antenna cover reception unit 46 is barely deflected at all.

In this case, the inner side surface of the upper lip 47*a* is in contact with the outer circumference of the lower end edge of the antenna cover 20, and covers this portion. In addition, a lower end of the lower lip 47*b* is pressed onto the roof 30 by the pressing force of the light pressing of the end surface 23 of the antenna cover 20 on the upper surface of the antenna cover reception unit 46, and is in contact therewith without a gap over the entire circumference of the outer ring section 41 of the pad 40.

Next, a case will be described in which the radius of curvature of the roof is smaller than that described above. As shown in FIG. 5, when the radius of curvature of the roof is small, the end surface 23 of the lower end edge of the antenna cover 20 is closer to the roof 30 (shown by "L2" in the figure). In other words, L1>L2. In this case, the end surface 23 of the lower end edge of the antenna cover 20 presses the antenna cover reception unit 46, and the antenna cover reception unit 46 is elastically deformed and deflected in the downward direction. With the deflection of the antenna cover reception unit 46, the inner side surface of the upper lip 47*a* is deformed toward the outer circumference of the lower end edge of the antenna cover 20, and comes into close contact with the outer circumference of the lower end edge of the antenna cover 20. Similarly, the lower end of the lower lip 47*b* is pressed by the roof 30 by the deflection of the antenna cover reception unit 46, and the lower end of the lower lip 47*b* and the roof 30 come into close contact with each other without a gap therebetween over the entire circumference of the outer ring section 41 of the pad 40.

As described, even when the spacing between the lower end edge of the antenna cover 20 and the roof 30 changes in accordance with a change in the radius of curvature of the roof, the variation of the position of the lower end edge of the antenna cover 20 is absorbed by the antenna cover reception unit 46 being deflected. In addition, in this process, the lip unit 47 is maintained in a state of close contact with the outer circumference of the lower end edge of the antenna cover 20 and in close contact with the roof 30. Therefore, generation of a gap between the lower end edge of the antenna cover 20 and the roof 30 can be inhibited.

Because of this, various data of the radii of curvature of the roof may be obtained for various roofs 30, an average of the radii of curvature of the roof may be calculated, and the shape of the lower edge of the antenna cover and the shapes of the antenna cover reception unit 46 and the lip unit 47 of the pad 40 may be designed based on the average radius of curvature, so that the various roofs having different radii of curvature can be handled. Thus, even for kinds of vehicles having different radii of curvature of the roof, the same roof antenna 1 may be used, the shape design and die for the antenna cover 20 for each kind of vehicle become unnecessary, and costs related thereto can be reduced.

In addition, because the lower end edge of the antenna cover 20 is always covered with the upper lip 47*a* even when the radius of curvature of the roof changes, an assembly defect of the antenna cover 20 due to exposure of the lower end edge of the antenna cover 20 can be inhibited, and a fine appearance can be maintained.

Figure 6:
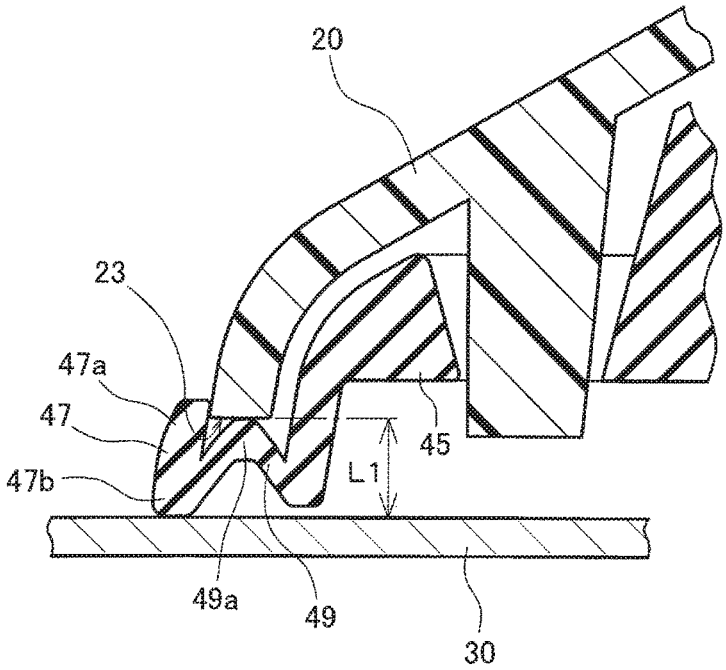
FIG. 6 is an enlarged cross sectional diagram of an alternative configuration of a pad, showing a state of an antenna cover and the pad when a radius of curvature of the roof is large.
Figure 7:
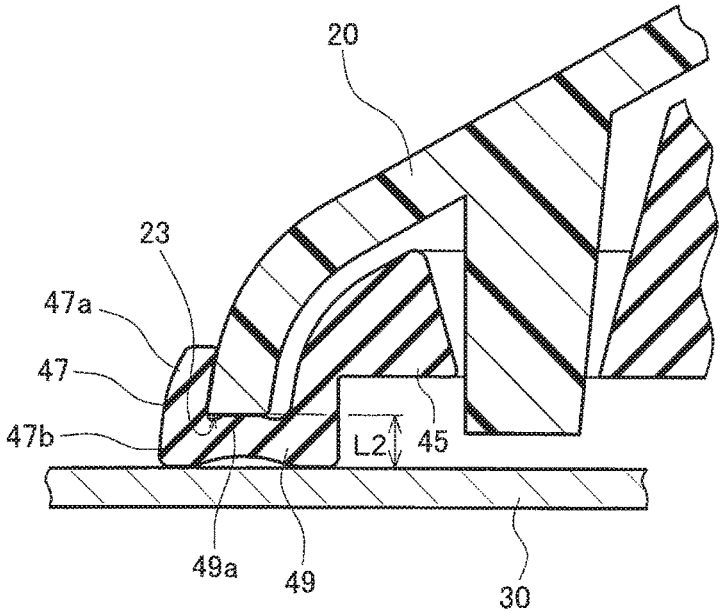
FIG. 7 is an enlarged cross sectional diagram of an alternative configuration of a pad, showing a state of an antenna cover and the pad when a radius of curvature of the roof is small.

Next, an alternative configuration of the antenna cover reception unit will be described. As shown in FIGS. 6 and 7, in an antenna cover reception unit 49, a curved portion 49*a* having a curved shape protruding in the upward direction is formed between the base 45 and the lip unit 47, in connection with both the lower end of the base 45 and the lower end of the lip unit 47. A protrusion height of the curved portion 49*a* is set such that the curved portion 49*a* always contacts the end surface 23 of the lower end edge of the antenna cover 20. The antenna cover reception unit 49 is formed from an elastic member similar to the antenna cover reception unit 46. Therefore, the curved portion 49*a* can elastically deform and deflect as a result of pressing by the end surface 23 of the lower end edge of the antenna cover 20.

FIG. 6 shows a state in which the roof antenna 1 is mounted on a roof 30 having a large radius of curvature. As shown in FIG. 6, in this state, the end surface 23 of the lower end edge of the antenna cover 20 and the roof 30 are distanced from each other (shown by "L1" in the figure), and the end surface 23 of the lower end edge of the antenna cover 20 is lightly pressed on a vertex of the curved portion 49*a* of the antenna cover reception unit 49. In this case, the curved portion 49*a* of the antenna cover reception unit 49 is barely deflected at all.

In this case, the inner side surface of the upper lip 47*a* is in contact with the outer circumference of the lower end edge of the antenna cover 20, and covers this portion. In addition, the lower end of the lower lip 47*b* is pressed onto the roof 30 by a pressing force of the light pressing of the end surface 23 of the antenna cover 20 on the curved portion 49*a* of the antenna cover reception unit 49, and is in close contact without a gap with the roof 30 over the entire circumference of the outer ring section 41 of the pad 40.

FIG. 7 shows a state where the roof antenna 1 is mounted on the roof 30 having a small radius of curvature. As shown in FIG. 7, in this state, the end surface 23 of the lower end edge of the antenna cover 20 is closer to the roof 30 (shown with "L2" in the figure), and the end surface 23 of the lower end edge of the antenna cover 20 presses the curved portion 49*a* of the antenna cover reception unit 49 so that the curved portion 49*a* of the antenna cover reception unit 49 is elastically deformed and deflected in the downward direction. With the deflection of the curved portion 49*a*, the upper lip 47*a* is deformed to fall toward the inner side, and the inner side surface of the upper lip 47*a* comes into close contact with the outer circumference of the lower end edge of the antenna cover 20. In addition, the lower end of the lower lip 47*b* is also pressed onto the roof 30 by the deflection of the curved portion 49*a* of the antenna cover reception unit 49, so that the lower end of the lower lip 47*b* and the roof 30 come into close contact with each other without a gap over the entire circumference of the outer ring section 41 of the pad 40.

Similarly to the above-described configuration, in this alternative configuration also, the position variation of the lower end edge of the antenna cover 20 due to the change of the spacing between the lower end edge of the antenna cover 20 and the roof 30 corresponding to the change of the radius of curvature of the roof is absorbed by the deflection of the curved portion 49*a* of the antenna cover reception unit 49. In addition, because the lip unit 47 is maintained in a state of close contact with the outer circumference of the lower end edge of the antenna cover 20 and close contact with the roof 30, a gap between the lower end edge of the antenna cover 20 and the roof 30 can be inhibited.

What is claimed is:

1. A roof antenna for a vehicle, mounted on a roof of a vehicle, comprising:

an antenna unit that receives radio waves;

an antenna cover that covers the antenna unit; and an annular pad interposed between the antenna cover and the roof, wherein the pad comprises:

an antenna cover reception unit formed from an elastic structure formed at a portion, of the pad, opposing a lower end of the antenna cover, and that is pressed by the lower end of the antenna cover to elastically deform in a pressed direction;

a lip unit formed at an outer circumferential end of the antenna cover reception unit, that covers an outer circumference of the lower end of the antenna cover, and that is in contact with the roof, and a base formed at an inner circumferential end of the antenna cover reception unit;

wherein the lip unit includes an upper lip disposed farther from the roof than an end surface of the lower end of the antenna cover is to the roof and contacting the outer circumference of the antenna cover; and wherein the lower end of the antenna cover is provided between the lip unit and the base; and the upper lip is deformed toward an outer circumference of a lower end edge of the antenna cover with elastic deformation of the antenna cover reception unit.

2. The roof antenna for vehicle according to claim 1, wherein the antenna cover reception unit has a curved shape protruding in an upward direction as a cross sectional shape in a circumferential direction of the annular shape.

* * * * *